US010807842B2

(12) United States Patent
Hall et al.

(10) Patent No.: US 10,807,842 B2
(45) Date of Patent: Oct. 20, 2020

(54) WEDGE-STYLE LINE CLAMP

(71) Applicants: David R. Hall, Provo, UT (US); Daniel Madsen, Vineyard, UT (US); Nathan Davis, Bountiful, UT (US)

(72) Inventors: David R. Hall, Provo, UT (US); Daniel Madsen, Vineyard, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 21 days.

(21) Appl. No.: 15/894,141

(22) Filed: Feb. 12, 2018

(65) Prior Publication Data

US 2019/0248632 A1 Aug. 15, 2019

(51) Int. Cl.
*B66D 1/34* (2006.01)

(52) U.S. Cl.
CPC ..... *B66D 1/34* (2013.01)

(58) Field of Classification Search
CPC ..... B66D 1/34
See application file for complete search history.

(56) References Cited

U.S. PATENT DOCUMENTS 1,913,508 A * 6/1933 Phillips ..... B66D 1/34 242/587.1
2,053,976 A * 9/1936 Stahl ..... B62D 43/045 254/375
2,151,837 A * 3/1939 Burke ..... B66D 1/34 24/115 R
2,329,943 A * 9/1943 Robins ..... B66D 1/34 242/587.1
4,787,602 A * 11/1988 Pidgeon ..... E01F 13/02 114/108
5,664,766 A * 9/1997 Baziuk ..... B66D 1/34 242/579
5,988,095 A * 11/1999 Kallenberger ..... B66D 1/34 114/230.23
6,981,670 B2 * 1/2006 Harrington ..... B65H 75/26 242/125.1
7,108,248 B2 * 9/2006 Winter ..... B66D 1/34 242/579
9,120,656 B2 * 9/2015 Yoder ..... B66D 1/34
9,758,357 B2 * 9/2017 Anderson ..... B66D 1/04
2002/0104918 A1 * 8/2002 Zacharias ..... B66D 1/34 242/587.1
2014/0166952 A1 * 6/2014 Heinrichs ..... B66D 1/34 254/266
2018/0179032 A1 * 6/2018 Hall ..... B66D 1/38
2018/0290866 A1 * 10/2018 Mupende ..... B66D 1/34

* cited by examiner

*Primary Examiner* — Michael E Gallion

(57) ABSTRACT

A device and method for retaining a line on a drum is disclosed. The drum has a slot which extends from a point along the periphery and into the drum in a first direction and at an acute angle relative to a tangent at the point. A clamp is provided with a slot portion and a line retaining portion. The slot portion is engaged with the slot such that relative movement between the clamp and the drum causes the slot portion to move in the first direction. As tension is applied to the line, a first force is created on the slot member in the first direction, resulting in a second force being applied by the line retaining portion in the first direction, clamping the portion of the line against the drum.

20 Claims, 12 Drawing Sheets

106

WEDGE-STYLE LINE CLAMP

TECHNICAL FIELD

The devices, systems, and methods described herein relate generally to lines on drums. More particularly, the devices, systems, and methods described herein relate to retaining lines on drums.

BACKGROUND

Attachment of lines to drums is accomplished in many ways. Most devices and methods for attachment, or retention, of lines on drums require specialized tools or complex procedures. These include crimping lines after insertion through slots on drums and bolting lines onto drums with various types of screws or bolts. End users who do not have these tools are then required to buy them or otherwise acquire them. Some end users do not have training sufficient to safely and effectively attach the lines.

SUMMARY

In a first aspect, the disclosure provides a drum with a slot. The slot extends from a point along the periphery and into the drum in a first direction and at an acute angle relative to a tangent at the point. A clamp is provided with a slot portion and a line retaining portion. The slot portion is engaged with the slot such that relative movement between the clamp and the drum causes the slot portion to move in the first direction. The line retaining portion is adapted to retain a portion of a line between the drum and the line retaining portion. As tension is applied to the line, a first force is created on the slot member in the first direction, resulting in a second force being applied by the line retaining portion in the first direction. This clamps the portion of the line against the drum.

In a second aspect, the disclosure provides a method for attaching a line to a drum. A drum is provided with a slot that extends from a point along the periphery and into the drum in a first direction and at an acute angle relative to a tangent at the point. A clamp is provided with a slot portion and a line retaining portion. The slot portion is engaged with the slot such that relative movement between the clamp and the drum causes the slot portion to move in the first direction. A portion of a line is retained between the line retaining portion and the drum by tensioning the line, resulting in a first force being created on the slot member in the first direction, resulting in a second force being applied by the line retaining portion in the first direction, thereby clamping the portion of the line against the drum.

The line may be wrapped around the drum at least twice such that tension is maintained by the friction of the line against the drum. The drum may be a winch drum. A surface of the line retaining portion that contacts the line may have ribbing, nubs, knobs, wrinkles, bumps, corrugation, furrows, teeth, or a combination thereof.

An end of the line may have an attachment that is larger than a gap between the line retaining portion and the drum when the slot portion engages the slot such that the attachment impinges on the line retaining portion as the line is tensioned.

The line may be a cable, wire, line, cord, twine, strand, thread, or rope.

The slot may be generally T-shaped and the slot portion may be shaped to fit inside the T-shape such that the slot portion slides in and out of the slot and is retained in the slot.

The line retaining portion may be adapted to be pulled opposite the first direction for line removal. The line retaining portion may be pushed by hand in the first direction. The line may be tensioned and the slot engaged simultaneously by hand.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "line" is meant to refer to cables, wires, cords, twine, strands, threads, and ropes, whether made from natural or man-made materials.

Figure 1A:
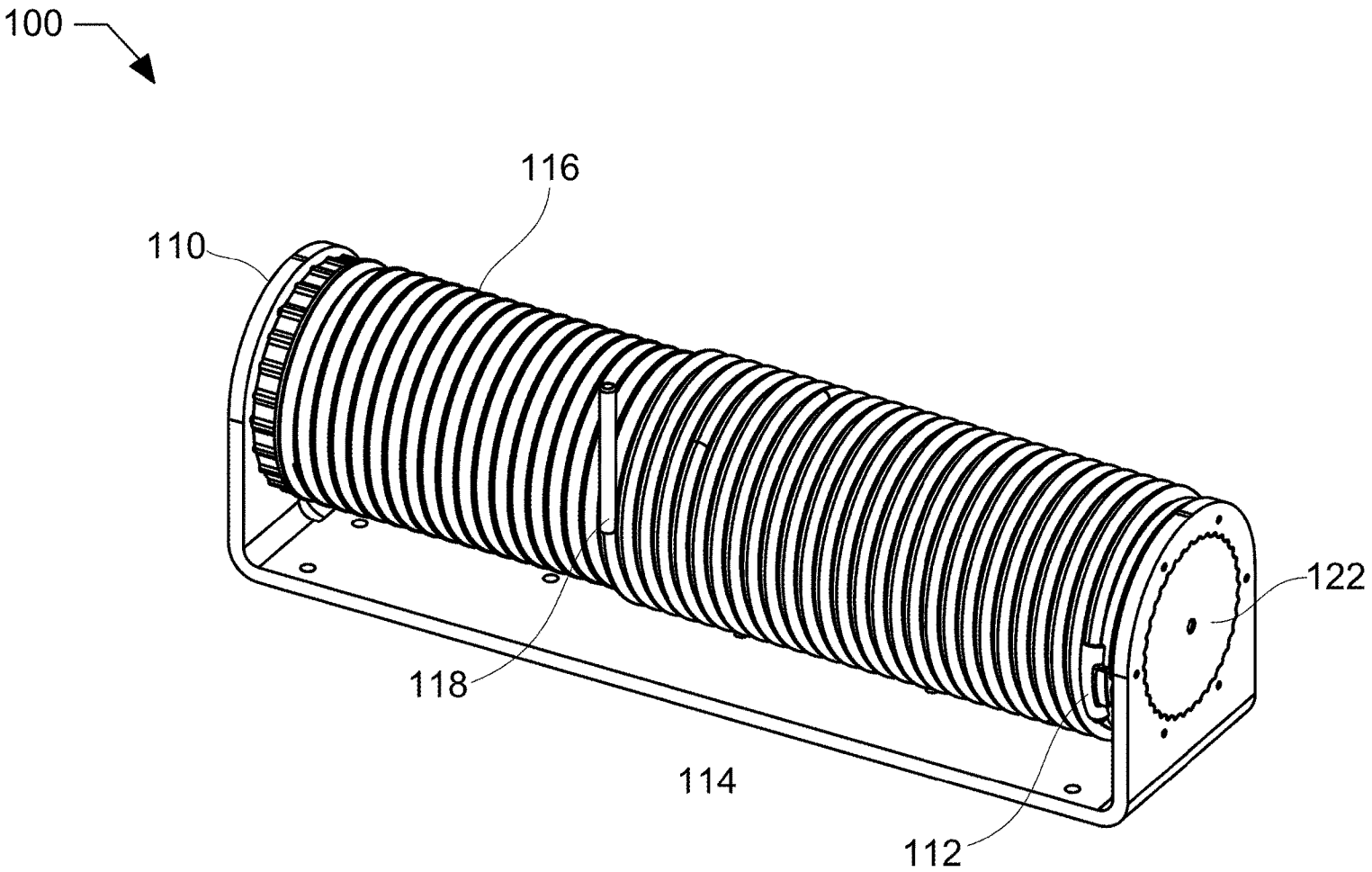
FIGS. 1A-I are a variety of isometric views of a winch with a clamp.
Figure 1B:
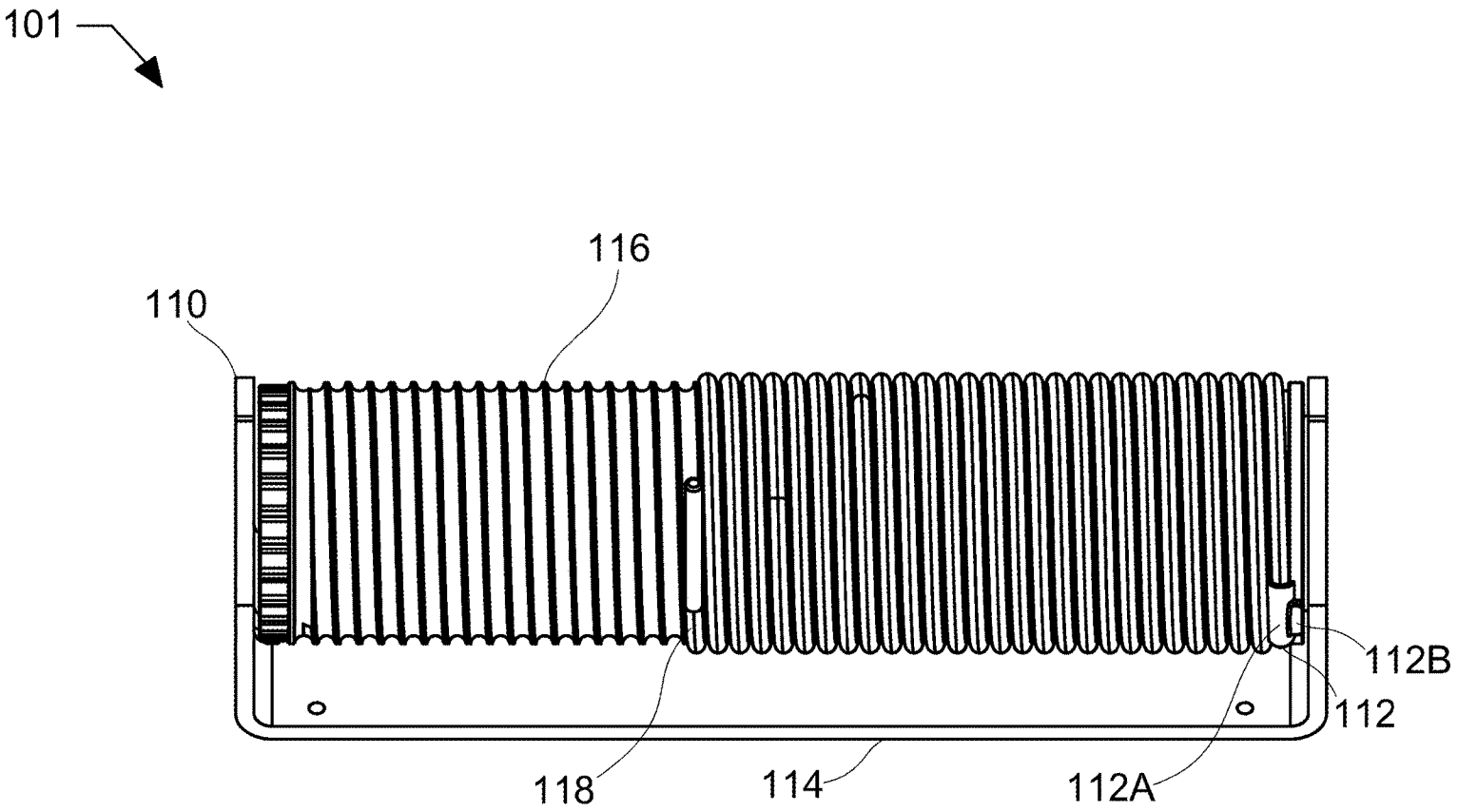
Figure 1C:
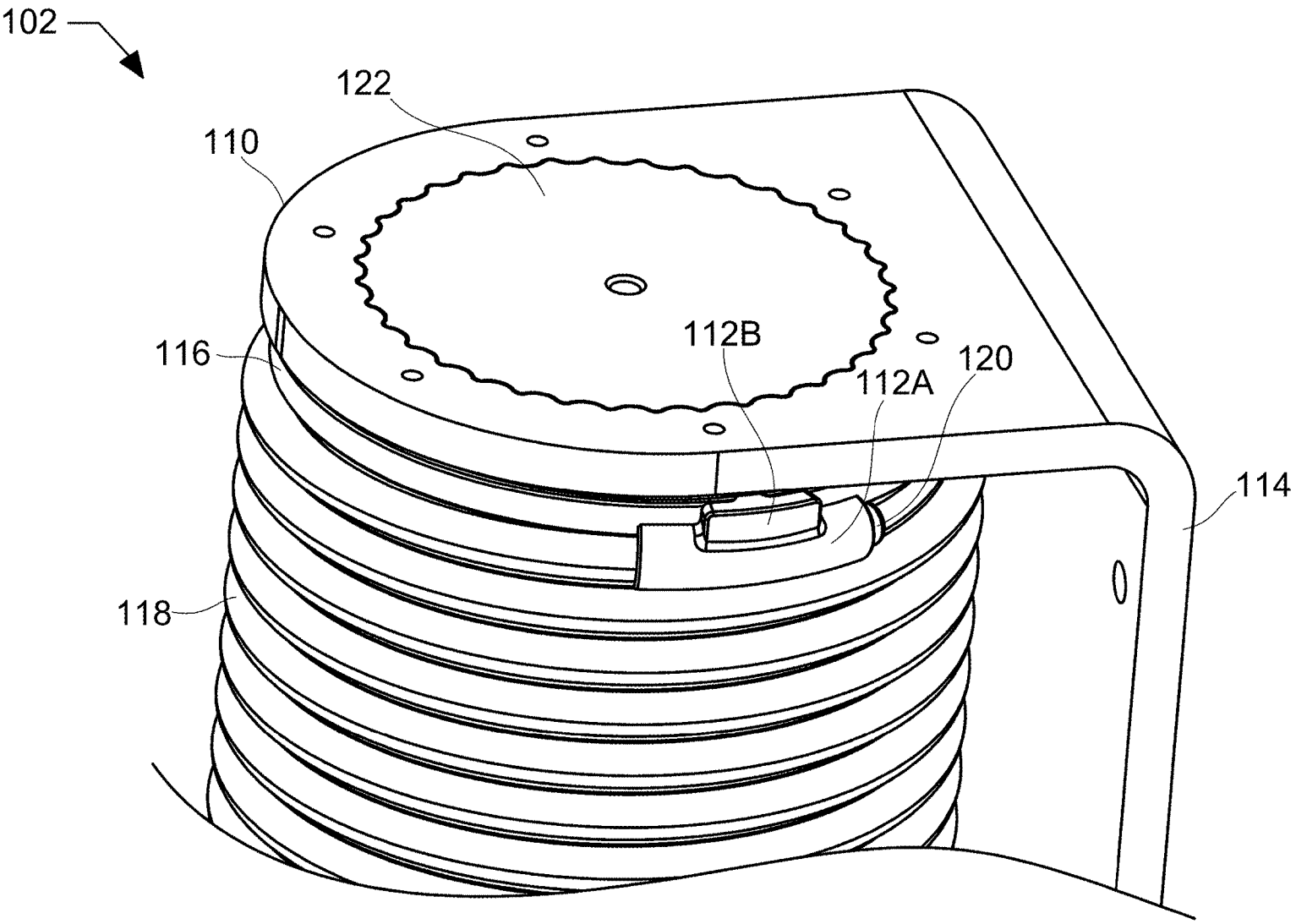
Figure 1D:
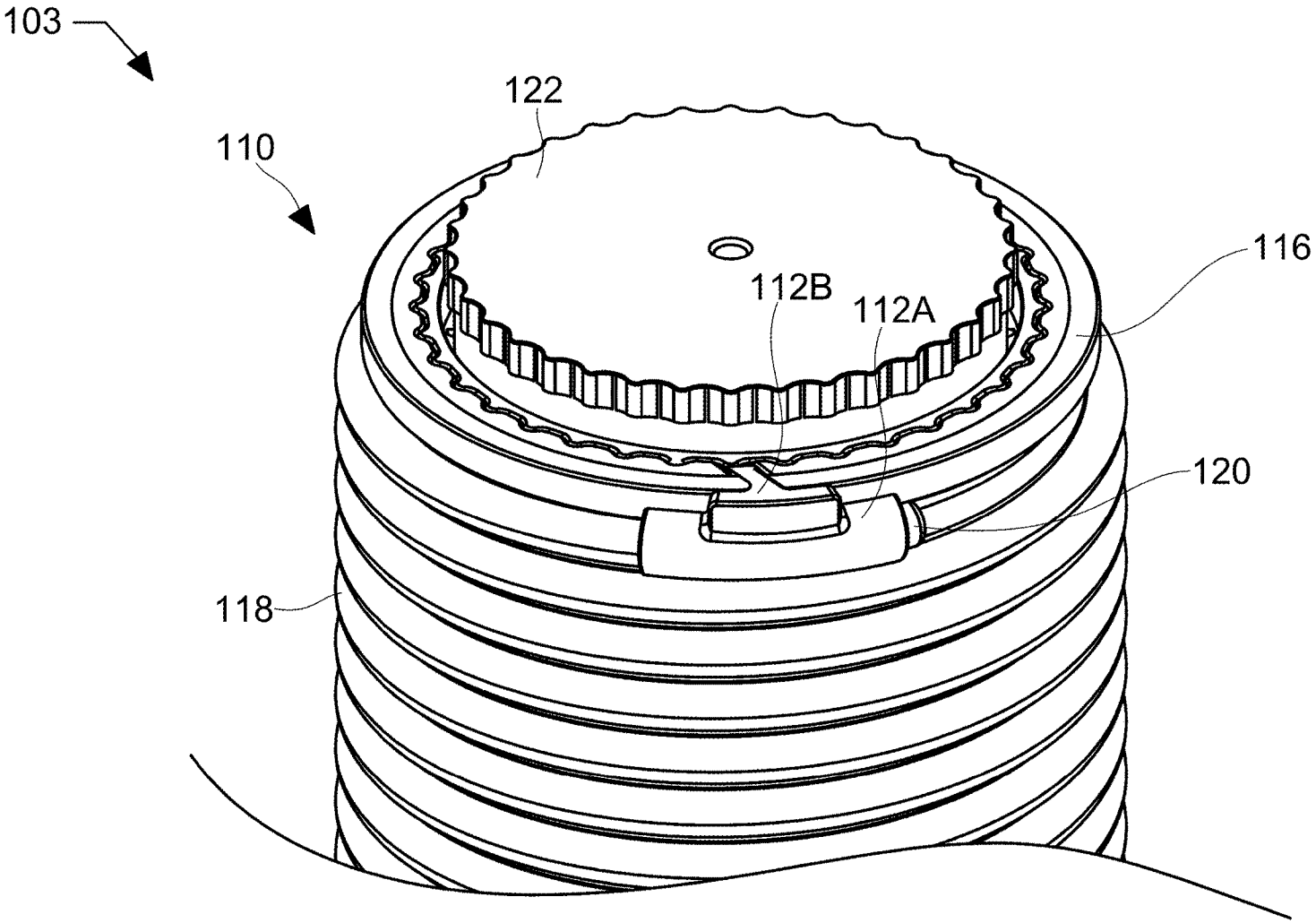
Figure 1E:
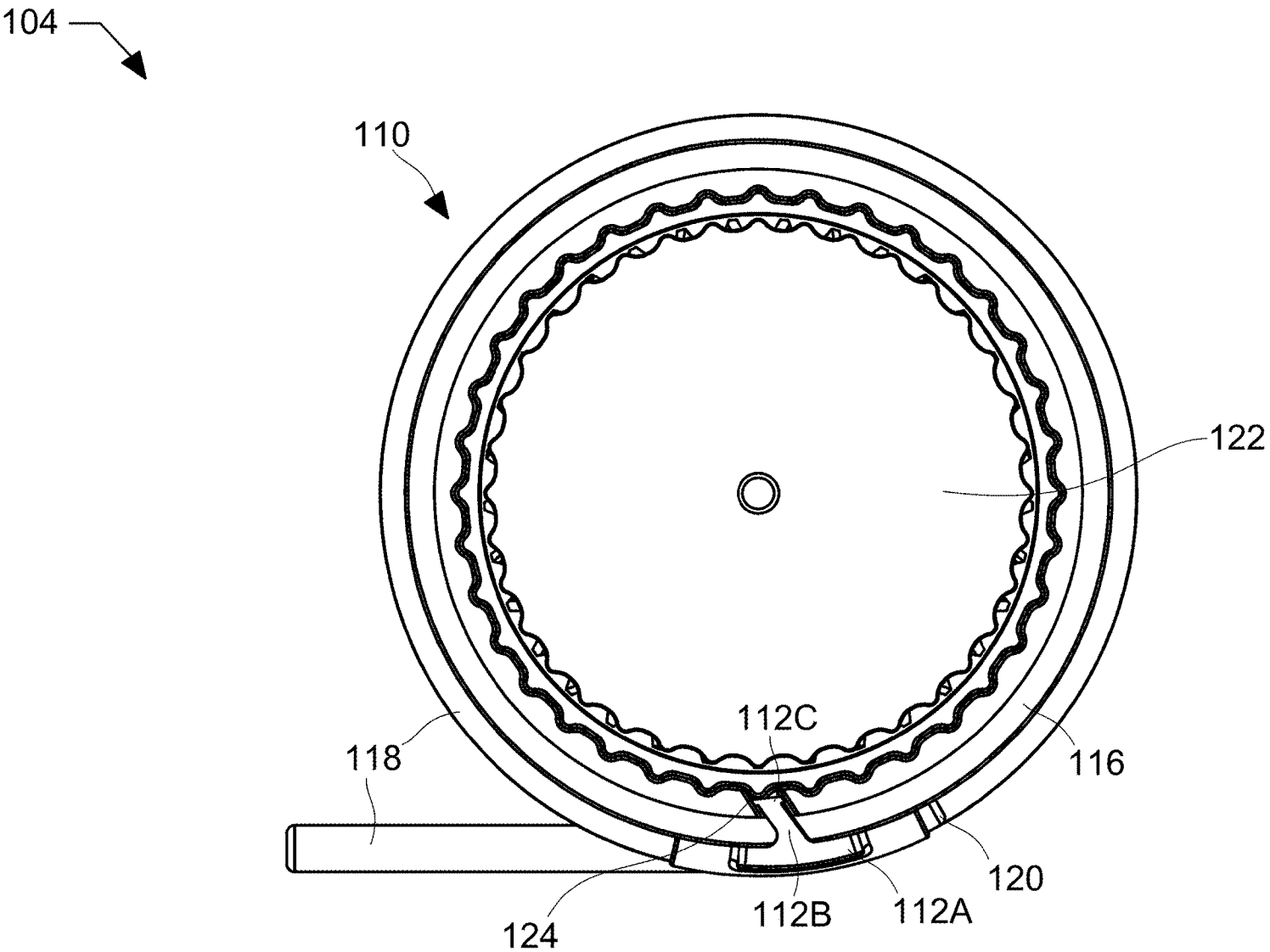
Figure 1F:
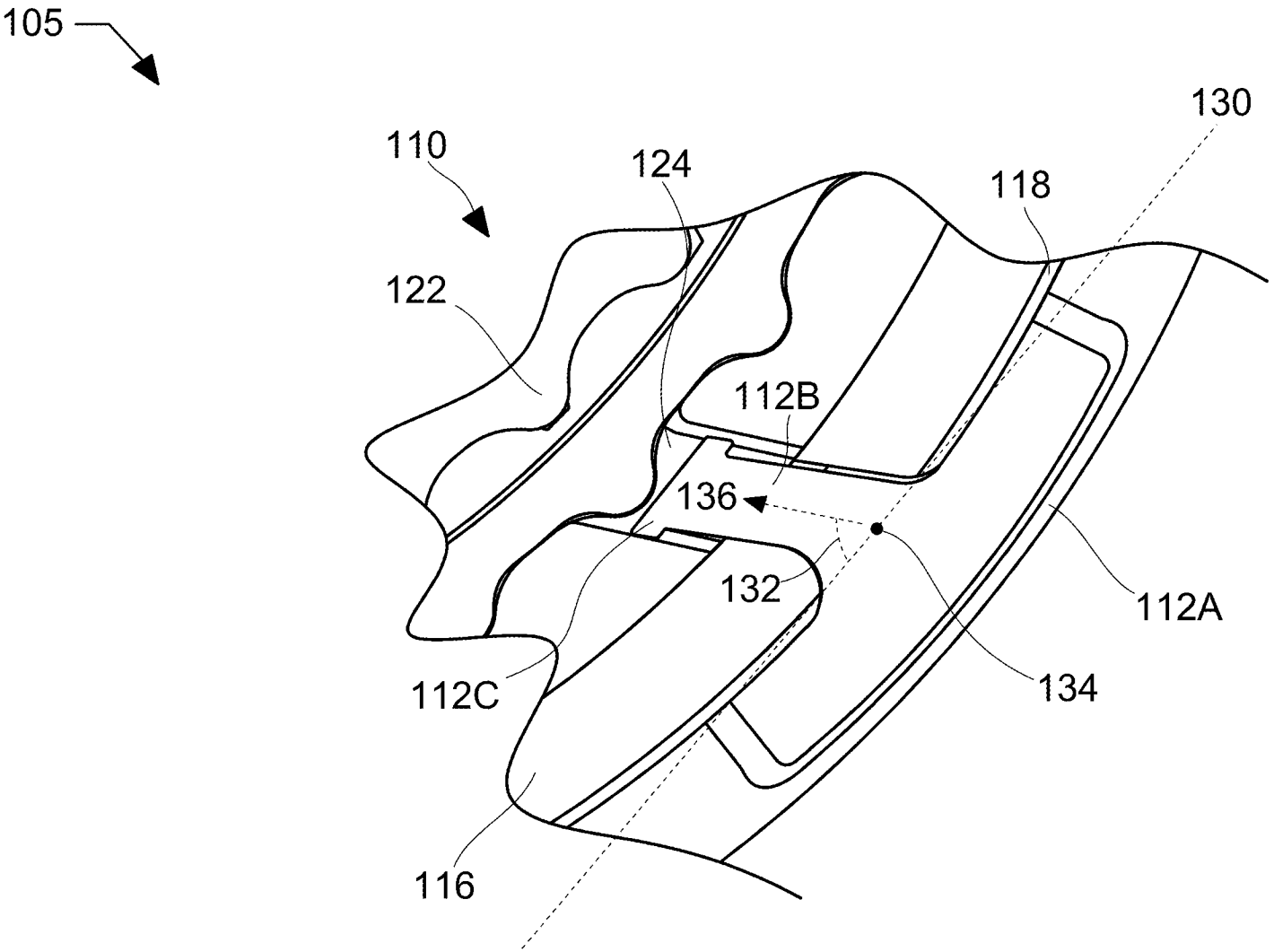
Figure 1G:
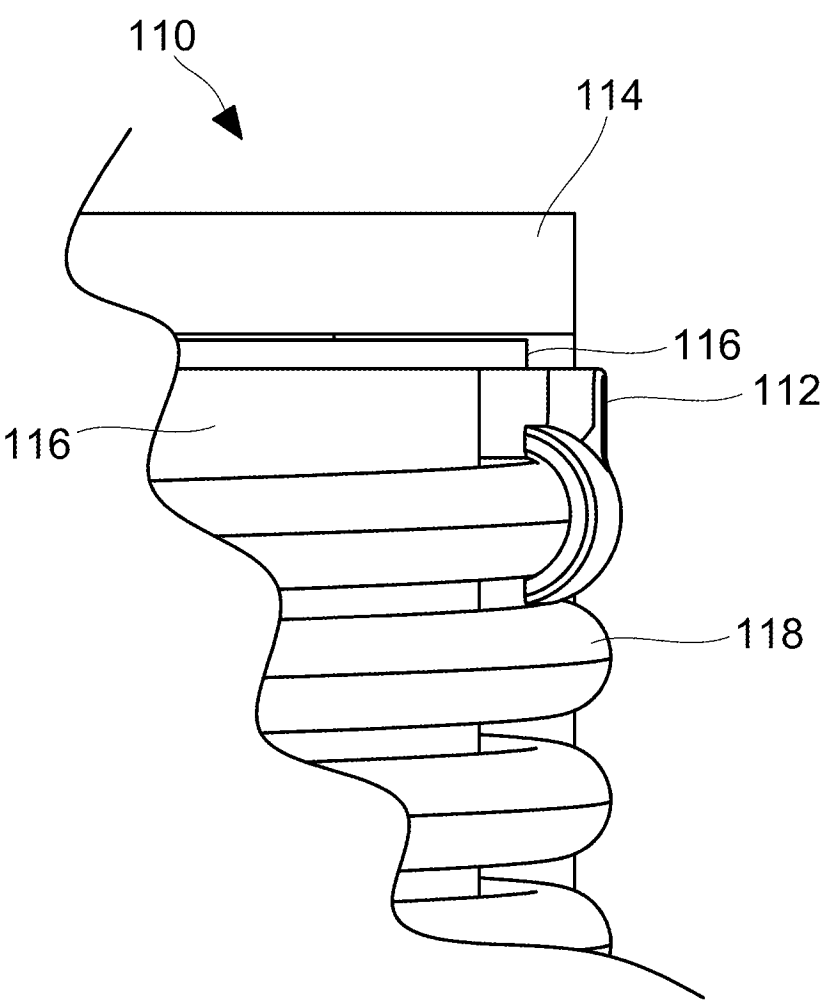
Figure 1H:
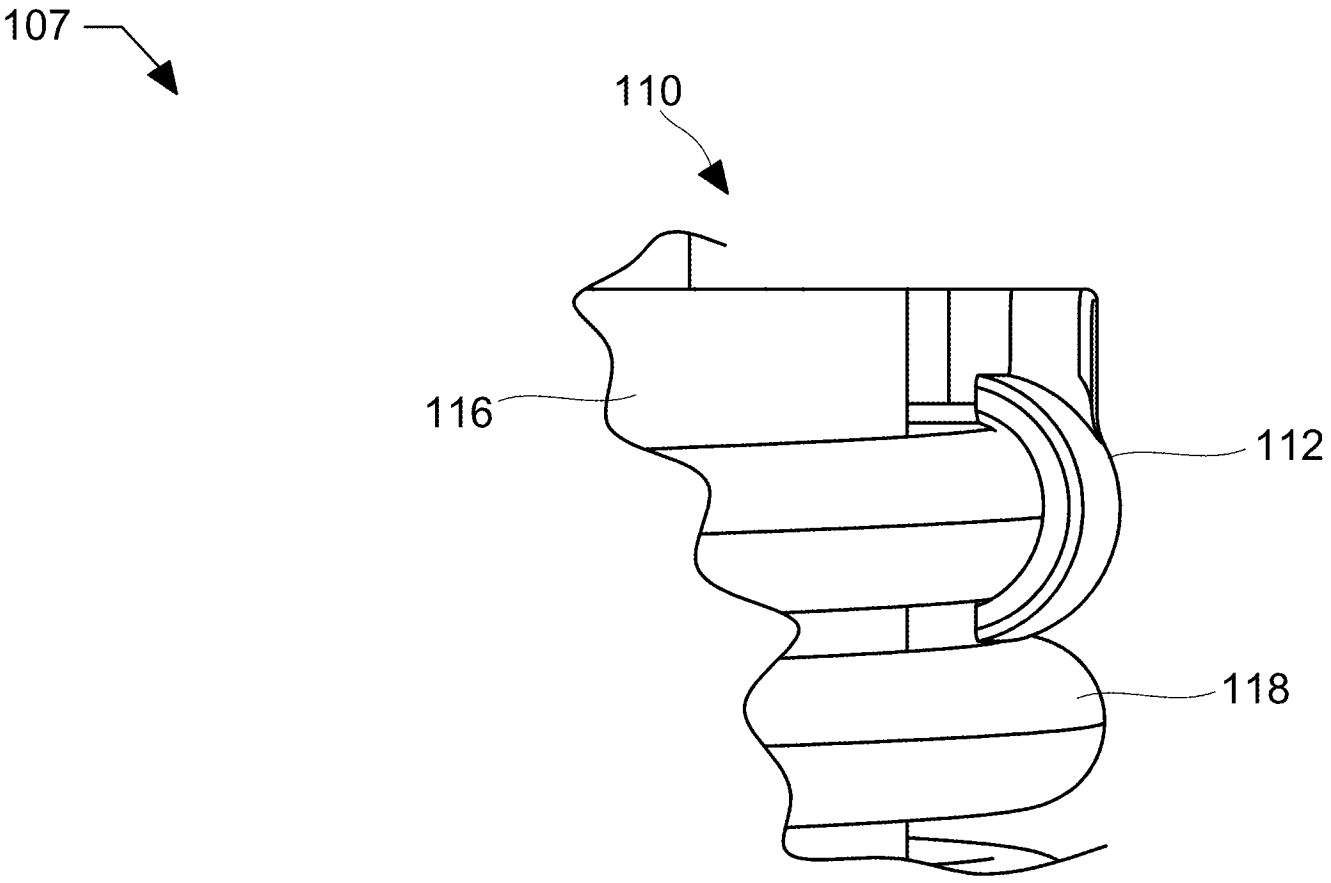
Figure 1I:
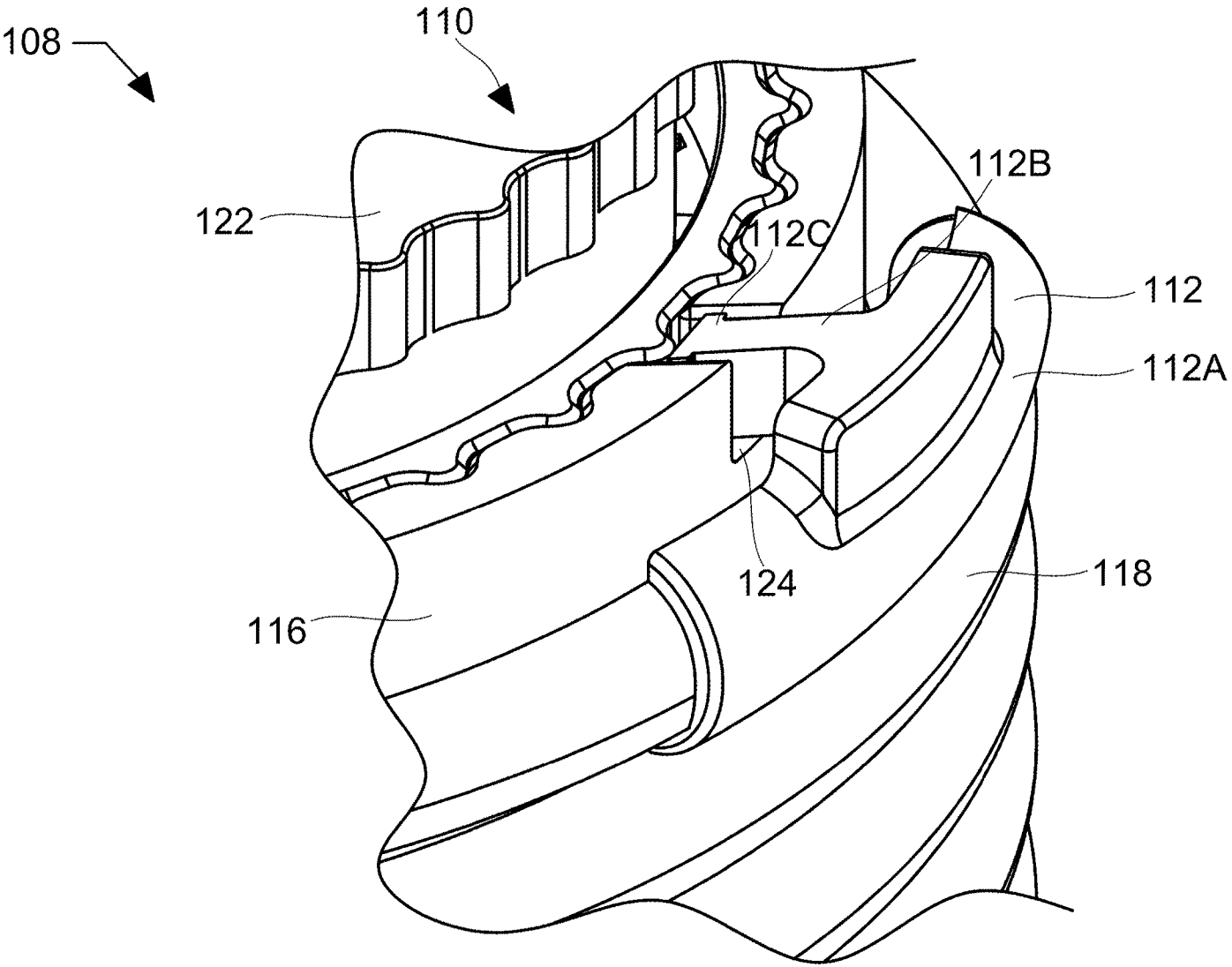

FIG. 1A is a front, top, right isometric view 100 of a winch may be used in the devices, methods, and systems disclosed herein. FIG. 1B is a front elevation view 101 of the winch of FIG. 1A. FIG. 1C is a front, right, top perspective view 102 of the right end of FIG. 1A, rotated 90 degrees counterclockwise. FIG. 1D is a modified view 103 of FIG. 1C with mounting portions of the winch removed. FIG. 1E is a right end elevation view 104 of FIG. 1A with mounting portions of the winch removed. FIG. 1F is a right end elevation view of the winch of FIG. 1A with mounting portions of the winch removed and zoomed into a clamp. FIG. 1G is a top view 106 of FIG. 1A zoomed into the clamp. FIG. 1H is a close-up view 107 of FIG. 1G. FIG. 1I is a close-up view 108 of the clamp portion of FIG. 1D.

Winch 110 includes a base 114, a drum 116, a clamp 112, a line 118, and a drum-base adapter 122. Drum 116 includes a slot 124. Line 118 has a tip 120 that has a larger diameter than the diameter of line 118. Slot 124 extends from a point 134 along the periphery of drum 116 into drum 116 in a first direction 136 at an acute angle 132 relative to a tangent 130 point 134. Clamp 112 includes a slot portion 112B, a line retaining portion 112A, and an optional clamp retainer 112C. The slot portion 112B engages the slot 124 such that relative movement between the clamp 112 and the drum 116 causes the slot portion 112A to move in the first direction 136. Line retaining portion 112A is adapted to retain a portion of line 118 between drum 116 and line retaining portion 112A. In some embodiments, line 118 is inserted between line retaining portion 112A and drum 116 and then line retaining portion 112A is pushed in the first direction 136 by hand. Tension applied to line 118 creates a first force on slot member 112B in the first direction, resulting in a second force being applied by line retaining portion 112A in the first direction 136, thereby clamping the portion of line 118 against drum 116.

In this embodiment, tip 120 of line 118 is larger than the gap between line retaining portion 112A and drum 116 when line 118 is clamped, and so tip 120 impinges on line retaining portion 112A and cannot pass through the gap. Tension applied to line 118 therefore further pulls on the tip 120, adding to the force pushing slot portion 112A into slot 124.

In this embodiment, slot 124 is generally T-shaped and clamp 112 is shaped to fit inside the T-shape such that slot portion 112B slides partially in and out of slot 124 but is retained in the slot by clamp retainer 112C butting against the arms of the T. In other embodiments, the clamp 112 may be retained by other shapes, or may be a removable piece.

Figure 2A:
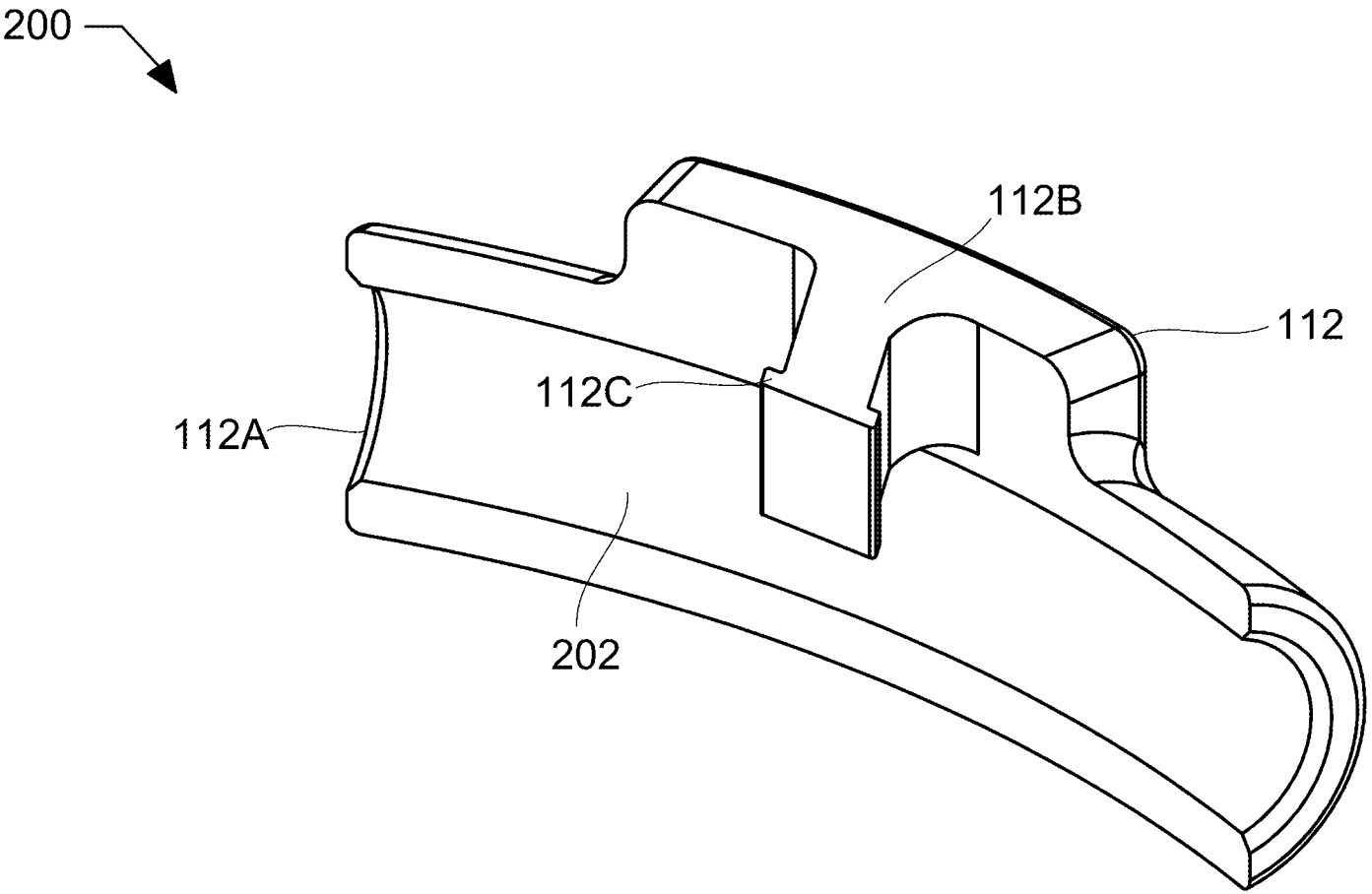
FIGS. 2A-B are top and bottom front isometric views of the clamp of FIGS. 1A-I.
Figure 2B:
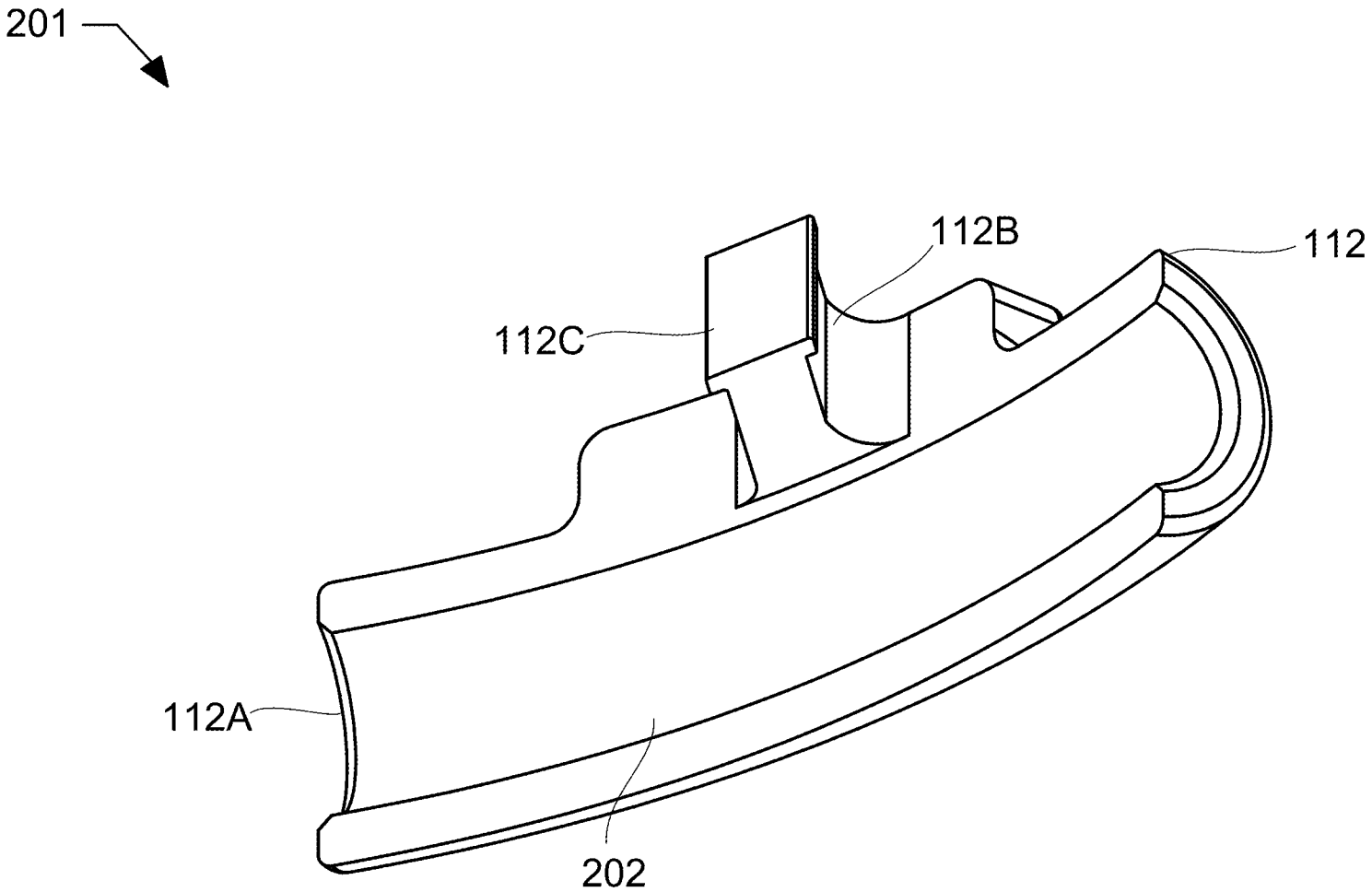

Now referring to FIG. 2, FIG. 2A is a top front isometric view 200 of clamp 112 of FIG. 1, removed from winch 110. FIG. 2B is a bottom front isometric view 201 of clamp 112. Line retaining portion 112A has a surface 202 that contacts line 118. Surface 202 may be smooth, as in the depicted embodiment. In other embodiments, surface 202 may be non-smooth, with ribbing, nubs, knobs, wrinkles, bumps, corrugation, furrows, teeth, or a combination thereof. In a preferred embodiment, there is at least a tip 120 on line 118 or a non-smooth surface 202. In a more preferred embodiment, there is a tip 120 on line 118 and a non-smooth surface 202.

Figure 3:
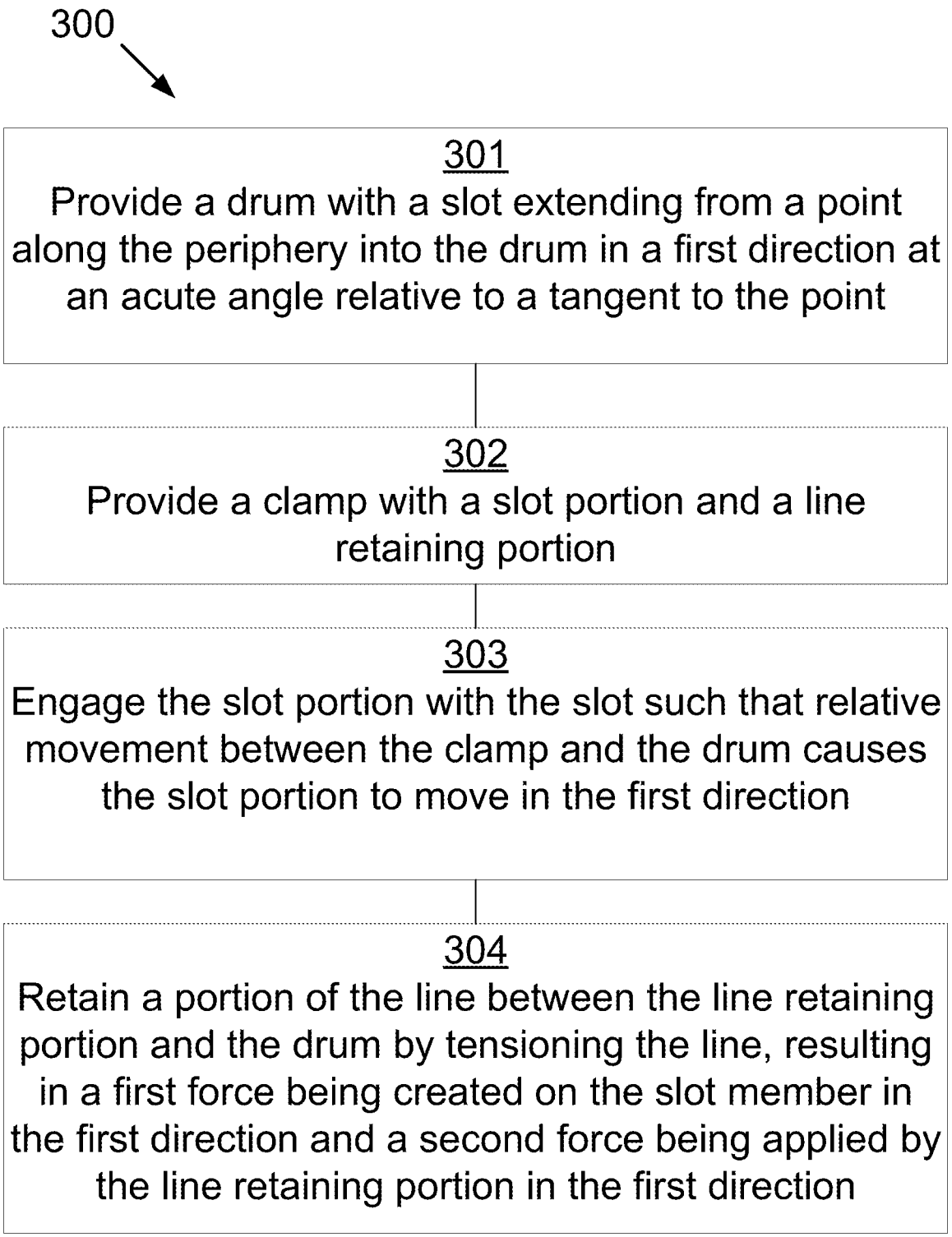
FIG. 3 is a method for retaining a line on a drum.

Now referring to FIG. 3, FIG. 3 is a method 300 for retaining a line on a drum. At 301, a drum is provided with a slot extending from a point along the periphery into the drum in a first direction and at an acute angle relative to a tangent at the point. At 302, a clamp is provided which has a slot portion and a line retaining portion. At 303, the slot portion is engaged with the slot such that relative movement between the clamp and the drum causes the slot portion to move in the first direction. At 304, a portion of a line is retained between the line retaining portion and the drum. At 305, the line is tensioned, resulting in a first force being created on the slot member in the first direction, and resulting in a second force being applied by the line retaining portion in the first direction, thereby clamping the portion of the line against the drum.

In some embodiments, the line is wrapped around the drum at least twice such that tension is maintained by the friction of the line against the drum.

In some embodiments, the drum is a winch drum. In some embodiments, the line comprises cables, wires, lines, cords, twine, strands, threads, or ropes.

In some embodiments, the line retaining portion is adapted to be pulled opposite the first direction for line removal. In other words, the clamp may be pulled at least partially out of the slot so that the line can be removed. A new line may then be placed in the gap and the line retaining portion may be pushed by hand in the first direction to attach a new line. The pushing of the line retaining portion and the tensioning of the line may be done simultaneously by hand.

All patents and published patent applications referred to herein are incorporated herein by reference. The invention has been described with reference to various specific and preferred embodiments and techniques. Nevertheless, it understood that many variations and modifications may be made while remaining within the spirit and scope of the invention.

What is claimed is:

1. A device comprising:

a drum comprising a slot extending from a point along the periphery and into the drum in a first direction and at an acute angle relative to a tangent at the point;

a clamp comprising a slot portion and a line retaining portion;

the slot portion engaging the slot such that relative movement between the clamp and the drum causes the slot portion to move in the first direction;

the line retaining portion adapted to retain a portion of a line between the drum and the line retaining portion; and whereby as tension is applied to the line a first force is created on the slot portion in the first direction, resulting in a second force being applied by the line retaining portion in the first direction, thereby clamping the portion of the line against the drum.

2. The device of claim 1, wherein the line is wrapped around the drum at least twice such that tension is maintained by the friction of the line against the drum.

3. The device of claim 1, wherein the drum is a winch drum.

4. The device of claim 1, wherein a surface of the line retaining portion that contacts the line comprises ribbing, nubs, knobs, wrinkles, bumps, corrugation, furrows, teeth, or a combination thereof.

5. The device of claim 1, wherein an end of the line comprises an attachment that is larger than a gap between the line retaining portion and the drum when the slot portion engages the slot such that the attachment impinges on the line retaining portion as the line is tensioned.

6. The device of claim 1, wherein the line is a cable, wire, cord, twine, or rope.

7. The device of claim 1, wherein the slot is generally T-shaped and the slot portion is shaped to fit inside the T-shape such that the slot portion slides in and out of the slot and is retained in the slot.

8. The device of claim 1, wherein the line retaining portion is adapted to be pulled opposite the first direction for line removal.

9. The device of claim 1, wherein the line retaining portion is pushed by hand in the first direction.

10. The device of claim 9, wherein the line is tensioned and the slot is engaged simultaneously by hand.

11. A method comprising:

providing a drum comprising a slot extending from a point along the periphery and into the drum in a first direction and at an acute angle relative to a tangent at the point;

providing a clamp comprising a slot portion and a line retaining portion;

engaging the slot with the slot portion such that relative movement between the clamp and the drum causes the slot portion to move in the first direction;

retaining a portion of a line between the line retaining portion and the drum by tensioning the line, resulting in a first force being created on the slot portion in the first direction, resulting in a second force being applied by the line retaining portion in the first direction, thereby clamping the portion of the line against the drum.

12. The method of claim 11, further comprising wrapping the line around the drum at least twice such that tension is maintained.

13. The method of claim 11, wherein the drum is a winch drum.

14. The method of claim 11, wherein a surface of the line retaining portion that contacts the line comprises ribbing, nubs, knobs, wrinkles, bumps, corrugation, furrows, teeth, or a combination thereof.

15. The method of claim 11, wherein an end of the line comprises an attachment that is larger than a gap between the line retaining portion and the drum when the slot portion engages the slot such that the attachment impinges on the line retaining portion as the line is tensioned.

16. The method of claim 11, wherein the line is a cable, wire, cord, twine, or rope.

17. The method of claim 11, wherein the slot is generally T-shaped and the slot portion is shaped to fit inside the T-shape such that the slot portion slides in and out of the slot and is retained in the slot.

18. The method of claim 11, further comprising pulling the line retaining portion opposite the first direction and removing the line.

19. The method of claim 11, further comprising pushing the line retaining portion by hand in the first direction.

20. The method of claim 19, wherein tensioning the line and engaging the slot comprises simultaneously pulling the line by hand while pushing the line retaining portion by hand in the first direction.

* * * * *